US008204396B2

(12) United States Patent
Hamby et al.

(10) Patent No.: US 8,204,396 B2
(45) Date of Patent: Jun. 19, 2012

(54) APPARATUS AND METHOD FOR ADJUSTMENT OF A PRINTER FUSER NIP

(75) Inventors: Eric Scott Hamby, Fairport, NY (US); Faming Li, Penfield, NY (US); Donald M. Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 462 days.

(21) Appl. No.: 12/473,578

(22) Filed: May 28, 2009

(65) Prior Publication Data

US 2010/0303493 A1 Dec. 2, 2010

(51) Int. Cl.
*G03G 15/20* (2006.01)

(52) U.S. Cl. ..... 399/67; 399/320; 399/328; 399/330; 219/216

(58) Field of Classification Search ..... 399/67, 399/68, 122, 320, 328–332, 338; 219/216, 219/219

See application file for complete search history.

(56) References Cited

U.S. PATENT DOCUMENTS

| | | | | |
|---|---|---|---|---|
| 6,687,468 | B2 * | 2/2004 | Holubek et al. | 399/45 |
| 6,819,890 | B1 | 11/2004 | Bott et al. | |
| 7,113,717 | B2 | 9/2006 | Bott et al. | |
| 2007/0071466 | A1 * | 3/2007 | Condello et al. | 399/45 |

OTHER PUBLICATIONS

Julie Marie Hanfland et al.; Method and Apparatus for Adjusting Nip Width Based on the Measured Hardness of a Fuser Roll in an Image Production Device; U.S. Appl. No. 12/335,962, filed Dec. 16, 2008.

Melissa Ann Monahan et al.; Method and Apparatus for Automatically Adjusting Nip Width Based on a Scanned Nip Print in an Image Production Device; U.S. Appl. No. 12/363,817, filed Feb. 2, 2009.

* cited by examiner

*Primary Examiner* — David Porta
*Assistant Examiner* — Jessica L Eley
(74) *Attorney, Agent, or Firm* — Ronald E. Prass, Jr.; Prass LLP

(57) ABSTRACT

An apparatus (100) and method (300) that adjusts a printer fuser nip is disclosed. The apparatus can include a media transport (110) configured to transport a media sheet (112) in a media sheet travel direction. The apparatus can include a fuser assembly (120) configured to fuse an image on the media sheet. The fuser assembly can include a fuser nip (126) that can have a fuser nip width (128) parallel to the media sheet travel direction. The apparatus can include a controller (130) coupled to the fuser assembly, where the controller can be configured to control operations of the apparatus. The apparatus can include a nip width profile generation module (140) coupled to the controller, where the nip width profile generation module can be configured to determine fuser nip width parameters based on media sheet properties and based on fuser assembly properties. The fuser assembly can be adjusted according to the fuser nip width parameters.

14 Claims, 4 Drawing Sheets

APPARATUS AND METHOD FOR ADJUSTMENT OF A PRINTER FUSER NIP

BACKGROUND

Disclosed herein is an apparatus and method that adjusts a printer fuser nip.

Presently, image output devices, such as printers, multifunction media devices, xerographic machines, ink jet printers, and other devices, produce images on media sheets, such as paper, substrates, transparencies, plastic, cardboard, or other media sheets. To produce an image, marking material, such as toner, ink jet ink, or other marking material, is applied to a media sheet to create a latent image on the media sheet. A fuser assembly then affixes or fuses the latent image to the media sheet by applying heat and/or pressure to the media sheet.

Fuser assemblies apply pressure using rotational members, such as fuser rolls or belts, that are coupled to each other at a fuser nip. Pressure is applied to the latent image on the media sheet as the media sheet is fed through the fuser nip. Unfortunately, repeated contact between the media sheet edges and a rotational fuser member result in worn areas, also known as edge wear, on the fuser member. The worn areas eventually manifest as differential gloss bands on resulting prints after fusing many sheets of one sheet width followed by fusing sheets of a larger sheet width. For example, a differential gloss band appears on 14" wide media sheets after running a large number of 11" wide media sheets. As it turns out, fuser run cost is a large part of the overall printer marking engine run cost, and edge wear is a leading cause of fusing failure regardless of print engine type, such as mono or color, or market segment, such as office or production. The edge wear occurs in both inboard and outboard areas on fusing members, where the level of wear in either area can dictate edge wear life.

Currently, the width of a fuser nip is fixed after fuser assembly installation regardless of paper type or fuser roll modulus. Also, current protocol for setting the fuser nip width requires the machine operator or service technician to first, insert a media sheet of a given size and type the fusing nip; second, engage and then disengage the fuser rolls; third, remove and dust the sheet with chalk powder where the powder will stick to the fuser oil that was transferred to the sheet when the fuser rolls were engaged; fourth, measure the resulting nip width impression on the sheet at specified inboard and outboard locations; fifth, adjust the inboard and outboard loads on the pressure roll as needed; and sixth repeat the first five steps until the nip width is within a desired specification. Obviously, the manual approach is time consuming and can be difficult. Also, because the fuser roll hardness can vary from roll-to-roll, fuser nip characteristics vary when the technician does not properly reset the fuser nip after installing a new fuser assembly or roll. Further edge wear and fuser problems occur when technicians do not correctly and consistently follow the proper procedures.

From an edge wear viewpoint, studies indicate that the current specifications for the fuser nip width and roll hardness are not adequate, especially because the specifications are traditionally dictated by fix, gloss, and stripping requirements and not by fuser edge wear. Tightening the spec on the manual nip setting process is not practical. Similarly, demanding a tighter spec on roll hardness is also not feasible.

Thus, there is a need for an apparatus and method that adjusts a printer fuser nip.

SUMMARY

An apparatus and method that adjusts a printer fuser nip is disclosed. The apparatus can include a media transport configured to transport a media sheet in a media sheet travel direction. The apparatus can include a fuser assembly configured to fuse an image on the media sheet. The fuser assembly can include a fuser nip that can have a fuser nip width parallel to the media sheet travel direction. The apparatus can include a controller coupled to the fuser assembly, where the controller can be configured to control operations of the apparatus. The apparatus can include a nip width profile generation module coupled to the controller, where the nip width profile generation module can be configured to determine fuser nip width parameters based on media sheet properties and based on fuser assembly properties. The fuser assembly can be adjusted according to the fuser nip width parameters.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
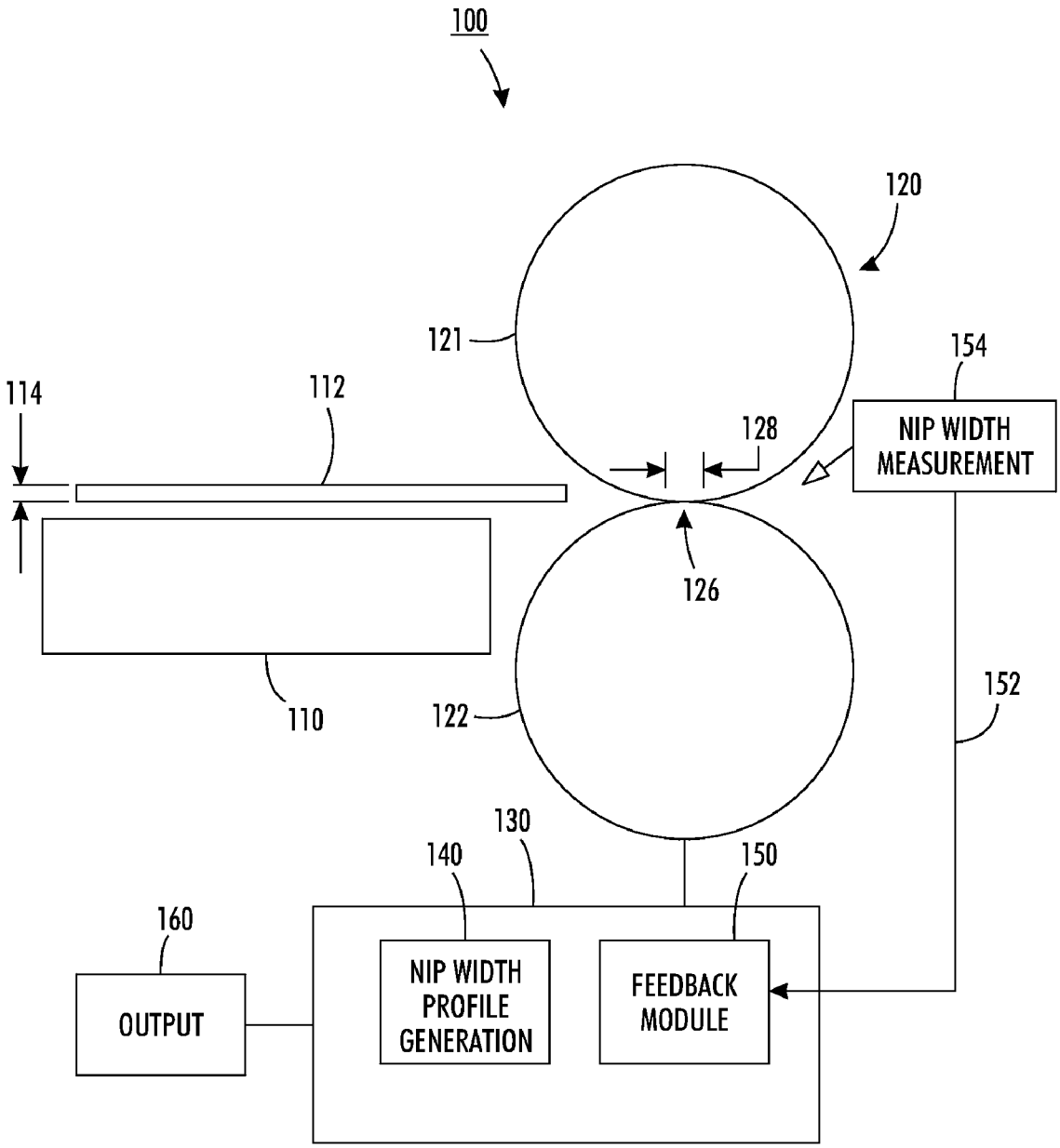
FIG. 1 is an exemplary illustration of a first view of an apparatus.

The embodiments include an apparatus that adjusts a printer fuser nip. The apparatus can include a media transport configured to transport a media sheet in a media sheet travel direction. The apparatus can include a fuser assembly configured to fuse an image on the media sheet. The fuser assembly can include a first fuser member rotationally supported in the apparatus, where the first fuser member can be configured to fuse an image on the media sheet. The fuser assembly can include a second fuser member rotationally supported in the apparatus and coupled to the first fuser member at a fuser nip, where the second fuser member can be configured to fuse an image on the media sheet and where the fuser nip can have a fuser nip width parallel to the media sheet travel direction. The apparatus can include a controller coupled to the fuser assembly, where the controller can be configured to control operations of the apparatus. The apparatus can include a nip width profile generation module coupled to the controller, where the nip width profile generation module can be configured to determine fuser nip width parameters based on media sheet properties and based on fuser assembly properties. The fuser assembly can be adjusted according to the fuser nip width parameters.

The embodiments further include a method of adjusting a printer fuser nip in an apparatus that can include a fuser assembly configured to fuse an image on a media sheet traveling in a media sheet travel direction, where the fuser assembly can include a fuser nip, where the fuser nip can have a fuser nip width parallel to the media sheet travel direction. The method can include determining fuser nip width parameters based on media sheet properties and based on fuser assembly properties. The method can include adjusting the fuser nip width based on the fuser nip width parameters to achieve an adjusted fuser nip width. The method can include transporting a media sheet through the fuser nip. The method can include fusing an image on the media sheet using the adjusted fuser nip width.

The embodiments further include a method of adjusting a printer fuser nip in an apparatus that can include a fuser assembly that can be configured to fuse an image on a media sheet traveling in a media sheet travel direction, where the fuser assembly can include a fuser nip, where the fuser nip can have a fuser nip width parallel to the media sheet travel direction. The method can include determining fuser nip width parameters based on media sheet properties and based on fuser assembly properties. The method can include adjusting the fuser nip width based on the fuser nip width parameters to achieve an adjusted fuser nip width. The method can include transporting a media sheet through the fuser nip with the adjusted fuser nip width. The method can include obtaining nip width feedback of the adjusted fuser nip width after transporting the media sheet through the fuser nip. The method can include further adjusting the fuser nip width based on the nip width feedback to achieve a feedback adjusted fuser nip width. The method can include fusing an image on the media sheet using the feedback adjusted fuser nip width.

Figure 2:
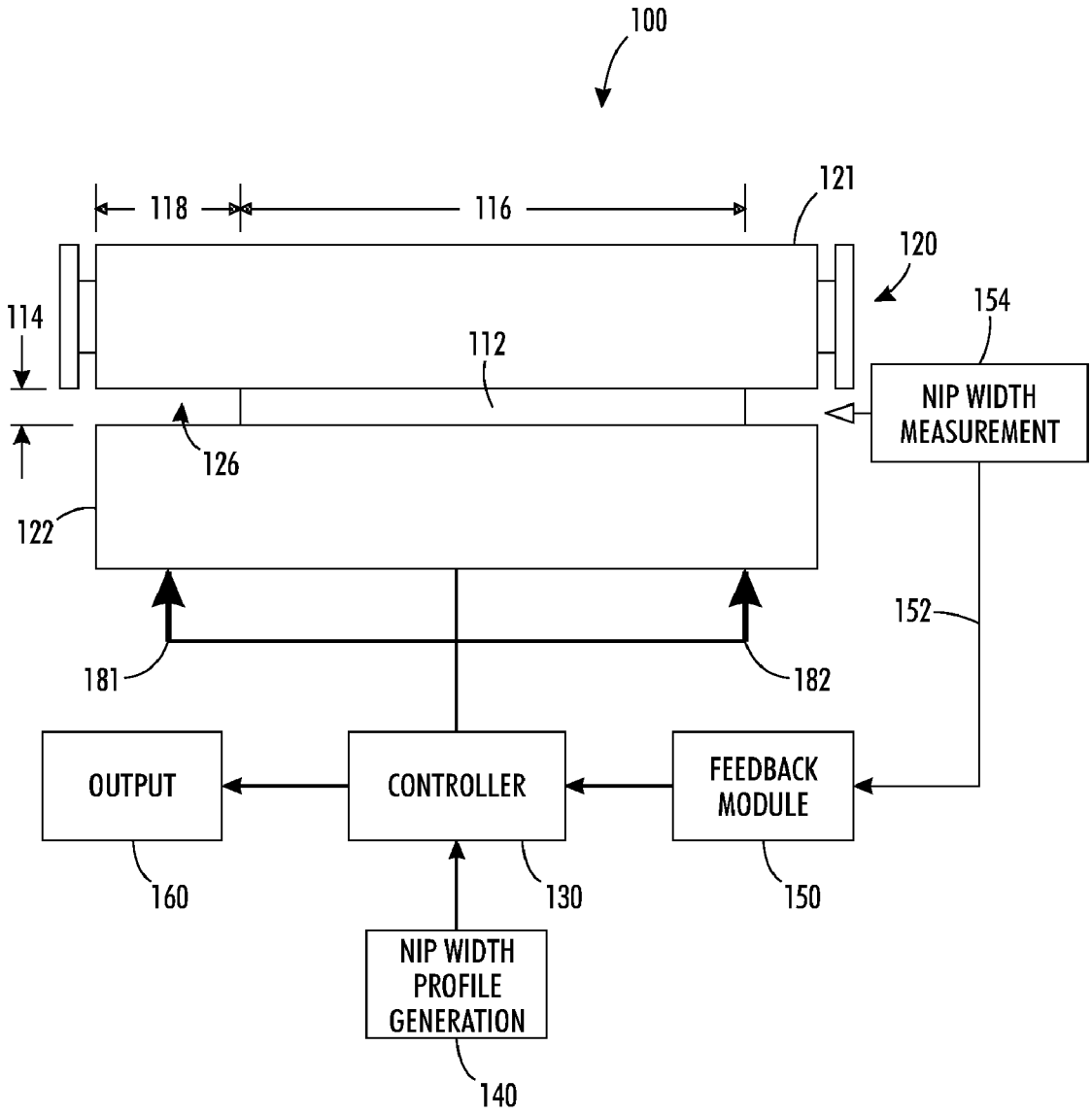
FIG. 2 is an exemplary illustration of a second view of an apparatus, the second view perpendicular to the first view.

FIG. 1 is an exemplary illustration of a first view of an apparatus 100. FIG. 2 is an exemplary illustration of a second view of an apparatus 100, the second view being perpendicular to the first view. The apparatus 100 may be or may be part of a printer, such as a laser printer, an ink jet printer, a copier, a multifunction media device, a xerographic machine, or any other device that generates an image on media. The apparatus 100 can include a media transport 110 configured to transport a media sheet 112 in a media sheet travel direction. The apparatus 100 can include a fuser assembly 120 configured to fuse an image on the media sheet 112. The fuser assembly 120 can include a first fuser member 121 rotationally supported in the apparatus 100, where the first fuser member 121 can be configured to fuse an image on the media sheet 112. The fuser assembly 120 can include a second fuser member 122 rotationally supported in the apparatus 100 and coupled to the first fuser member 121 at a fuser nip 126. The second fuser member 122 can be configured to fuse an image on the media sheet 112. The fuser nip 126 can have a fuser nip width 128 parallel to the media sheet travel direction. For example, the fuser nip width 128 can be the distance along the media sheet travel direction where the two fuser members 121 and 122 are in contact with each other. As a further example, the fuser nip width 128 can be parallel to rotational operation of the fuser members 121 and 122 and can be perpendicular to a thickness 114 of the media sheet 112.

Elements of the illustrations may be exaggerated for illustrative purposes and the elements are not necessarily drawn to scale. For example, the fuser members 121 and 122 generally contact each other to create the nip 126 and the apparent gap between the fuser members 121 and 122 in FIG. 2 may only exist in the drawing to show the presence of the media sheet 112 with an exaggerated thickness 114. Portions of the fuser members 121 and 122 can be deformable and can contact each other at the nip 126 outside of the edges of the media sheet 112.

The apparatus 100 can include a controller 130 coupled to the fuser assembly 120, where the controller 130 can be configured to control operations of the apparatus 100. The apparatus 100 can include a nip width profile generation module 140 coupled to the controller 130, where the nip width profile generation module 140 can be configured to determine fuser nip width parameters based on media sheet properties and based on fuser assembly properties. The nip width profile generation module 140 can be configured to determine the fuser nip width parameters based on media sheet properties and based on fuser assembly properties to determine fuser nip width parameters that reduce edge pressure and shear stress at a media sheet edge. The fuser assembly properties can include fuser assembly hardness, such as fuser assembly durometer or fuser assembly modulus. The media sheet properties can include media sheet size and media sheet properties can include media sheet thickness 114. Media sheet properties can also include media sheet surface characteristics, such as coating and/or finishing, can include media sheet width 116 that can be perpendicular to the nip width 128, can include media sheet grain direction, can include media sheet length that can be parallel to the nip width 128, can include media sheet location 118, and can include other media sheet properties.

The fuser assembly 120 can be configured to be adjusted according to the fuser nip width parameters. For example, the nip width profile generation module 140 can be configured to provide the fuser nip width parameters to the controller 130 and the controller 130 can be configured to adjust the fuser nip width 128 based on the determined fuser nip width parameters. As a further example, the fuser nip width parameters can include load suggestions or other parameters related to the fuser nip width 128 and a user or the controller 130 can adjust fuser assembly loads according to the fuser nip width parameters to achieve a more desirable fuser nip width 128.

The apparatus 100 can include a feedback module 150 coupled to the controller 130. The feedback module 150 can be configured to adjust the fuser nip width parameters based on nip width feedback 152 to achieve a desired fuser nip width 128. The feedback 150 module can be configured to adjust the fuser nip width 128 based on the nip width feedback 152 to achieve a desired fuser nip width 128 to reduce media sheet delta gloss variation.

The apparatus 100 can include a nip width measurement module 154 configured to provide nip width feedback 152 in the form of at least one nip width measurement relating to nip width 128. For example, the nip width measurement module 154 can measure the length 128 that the fuser assembly rotational members 121 and 122 are in contact with each other along a media sheet travel direction, such as along a media sheet movement direction. The controller 130 can adjust the fuser nip width 128 by adjusting a fuser assembly load based on the determined fuser nip width parameters and based on the nip width feedback 152.

The controller 130 can adjust the fuser assembly load by adjusting a first load 181 at the first end of the fuser assembly 120 and adjusting a second load 182 at the second end of the fuser assembly 120 based on the determined fuser nip width parameters and based on the nip width feedback 152. For example, the controller 130 can adjust pressure between two fuser assembly rotational members 121 and 122 to adjust the fuser nip width 128 between the two fuser assembly rotational members 121 and 122. Fuser assembly rotational members can be pressure rolls or belts, can be fuser rolls or belts, can be a combination of pressure rolls or belts and fuser rolls or belts, or can be any other fuser members that can have an adjustable fuser nip. The controller 130 can adjust the load using bladders, cams, screws, or any other devices that can adjust a load to adjust pressure between fuser assembly rotational members.

The apparatus 100 can include an output 160 configured to receive the fuser nip width parameters and configured to output the fuser nip width parameters to a user of the apparatus 100. The output 160 can be a display that can visually output the fuser nip width parameters, can be an audio interface that can audibly output the fuser nip width parameters, can be a transceiver that can transmit the fuser nip width parameters to a separate user device, such as a handheld device, or can be any other output. The user can then use the fuser nip width parameters to make adjustments to the fuser assembly 120 to adjust the fuser nip width 128 according to the fuser nip width parameters.

The optimal nip width profile is not necessarily the same for different paper types and is not necessarily symmetric from one end of the fuser assembly 120 to the other end. Also, small changes in nip width 128 will not necessarily perceptively affect the fix of an image on the media sheet 112 nor will small changes necessarily affect gloss on the media sheet 112, although changes can be made to affect the fixed image and media sheet gloss. Thus, small changes in nip width 128 can reduce edge wear while maintaining a desired perceived image and/or gloss on a media sheet 112.

Embodiments can provide for mitigation of media sheet edge wear on a fuser assembly 120. This can be done with the nip width profile generation module 140. This can also be done with nip width measurement module 154 that can provide a feedback loop 152 for adjusting the nip 126 to implement a reference nip width profile. The nip width profile generation module 140 can improve mean edge wear life by selecting the nip width profile that minimizes edge pressure and shear stress at the media sheet edge. The nip width measurement module 154 can also reduce variation, such as delta gloss variation.

Paper type information, such as thickness, size, coating, etc, and fuser roll modulus can be given or can be computed a priori to generate optimal nip width profiles. For example, fuser roll hardness can be measured when the roll is manufactured and the information can be stored on a device attached to the fuser roll. In this way, roll hardness information can be uploaded to the controller 130 each time a new roll is installed. Alternatively, fuser roll hardness/modulus can be computed in situ. Given the paper type and roll hardness information, inboard and outboard loads can be iterated to minimize the normal pressure and shear stress at the media sheet edges, which may also be subject to constraints on the nip width 128 for fix, gloss, and stripping. The outcome of this iterative process can give an improved nip width profile for the given roll modulus and paper type pair.

The optimal nip width profile is not necessarily the same for different paper types. Furthermore, the optimal nip width profile is not even necessarily symmetric going from inboard to outboard. The reason this is the case is that in an edge registered system, sheets entering the fuser nip are not necessarily centered with respect to the axial position of the fuser roll. Also, a pressure roll, such as the second fuser member 122, can have a symmetric flare built into the roll, and since the sheets are not necessarily centered in the fusing nip, the pressure distribution over the sheet in the nip may not be symmetrical either. To balance the edge pressure and shear stress at the sheet edge, the optimal nip width profile can be asymmetric.

The optimal nip width profile can be a small perturbation, such as approximately 5%, about the nominal setting. Small changes to the nip 126 can lead to large changes in delta gloss. Thus, while small changes in the nip 126 can change edge wear, these changes should not impact overall fix and gloss on the media sheet 112. Therefore, the nip width 128 can be actuated to mitigate edge wear without impacting other elements critical to image production.

Once the reference nip width profile has been generated, the feedback loop 152 can be used to automatically adjust the nip 126 to achieve a more desired profile. The feedback loop 152 can improve both precision and accuracy, which can reduce delta gloss variation. Sensing the nip width profile with the nip width measurement module 154 can be accomplished using various sensors or other nip width profile measuring techniques. For example, a nip width print can be generated that a machine operator/service technician can then measure by hand. The procedure can be automated by adding a full-width array sensor or digital camera in the paper path, to automatically scan, measure, and analyze the nip width print in situ and in real time. This measurement can then be fed back to the controller 130.

Just as there are several options for sensing nip width, there are also several options for actuating inboard and outboard loads 182 and 181 used to set the nip width 128. For instance, independent motors can be attached to screws that are currently used to adjust the inboard and outboard springs. Loads can also be adjusted by actuating the positions of dual cams. Pneumatic systems for achieving nip pressure can also be used. For this type of system, air pressure in inboard and outboard bladders can be independently controlled to achieve a desired nip width 128.

While the process can be fully automated, other embodiments can use just the nip width profile generation module 140 and report the output of the nip width profile generation module 140 to a machine operator or service technician via the output 160, such as via a user interface or via a separate device, such as a personal digital assistant. The machine operator/service technician can then manually implement the nip width profile from the nip width profile generation module 140 using the current procedure. This reduced scale implementation can work with machines that run primarily one class of media, such as heavyweight stock, because it can tailor the nip 126 to the predominant media usage associated with the apparatus 100. This can improve the mean edge wear life. The reduced scale implementation also may not need additional sensors and actuators associated with the feedback loop 152.

Embodiments can provide for increased mean edge wear life and reduced variability by computing optimal fuser nip width profiles based on media properties and fuser roll material properties in a feed-forward manner and by using feedback control to adjust automatically inboard and outboard loads to achieve and maintain the desired fuser nip width.

Figure 3:
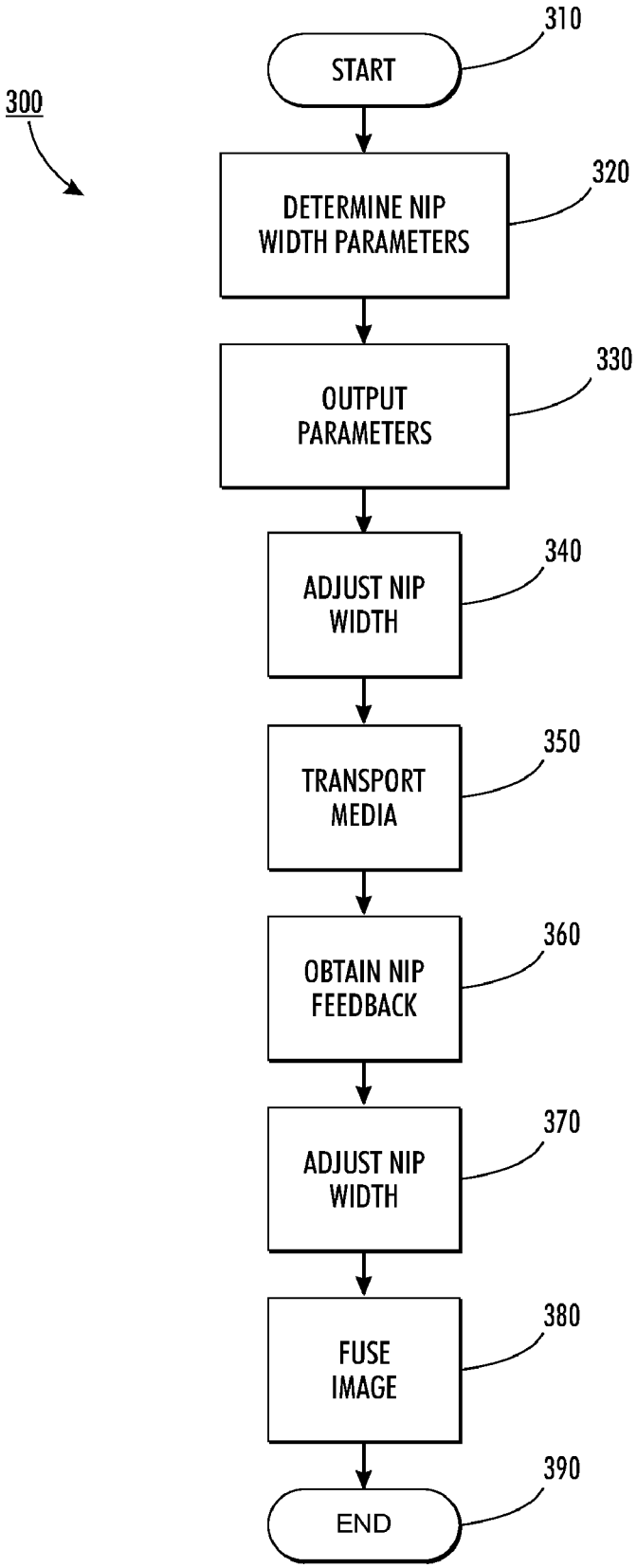
FIG. 3 illustrates an exemplary flowchart of a method of adjusting a printer fuser nip in an apparatus.

FIG. 3 illustrates an exemplary flowchart 300 of a method of adjusting a printer fuser nip in an apparatus that can include a fuser assembly configured to fuse an image on a media sheet traveling in a media sheet travel direction, where the fuser assembly can include a fuser nip, and where the fuser nip can have a fuser nip width parallel to the media sheet travel direction. The method starts at 310. At 320, fuser nip width parameters can be determined based on media sheet properties and based on fuser assembly properties. The fuser assembly properties can include fuser assembly hardness and the media sheet properties can include media sheet size and thickness. At 330, the fuser nip width parameters can be output to a user of the apparatus. The fuser nip width parameters can be output at any time during the method 300 or may not be output at all.

At 340, the fuser nip width can be adjusted based on the fuser nip width parameters to achieve an adjusted fuser nip width. The fuser nip width can be automatically adjusted by a controller or can be manually adjusted by a user. The fuser nip width can be adjusted by adjusting a fuser assembly load based on the fuser nip width parameters to achieve an adjusted fuser nip width.

At 350, a media sheet can be transported through the fuser nip. At 360, nip width feedback can be obtained after transporting the media sheet through the fuser nip. The nip width feedback can be obtained by taking nip width measurements while and/or after transporting the media sheet through the fuser nip.

At 370, the fuser nip width can be further adjusted based on the nip width feedback to achieve a feedback adjusted fuser nip width. Adjusting in either or both 340 and 370 can be performed by adjusting a first load at the first end of the fuser assembly and by adjusting a second load at the second end of the fuser assembly based on the fuser nip width parameters and/or based on the nip width feedback to achieve a feedback adjusted fuser nip width. At 380, an image can be fused on the media sheet using the adjusted fuser nip width. The image can also be fused on the media sheet using the feedback adjusted fuser nip width. At 390, the method 300 can end.

According to a related embodiment, at 320, fuser nip width parameters can be determined based on media sheet properties and based on fuser assembly properties. Determining the fuser nip width parameters can include determining the fuser nip width parameters based on media sheet properties and based on fuser assembly properties to determine fuser nip width parameters that reduce edge pressure at a media sheet edge, reduce shear stress at a media sheet edge, and/or reduce media sheet delta gloss variation. At 340, the fuser nip width can be adjusted based on the fuser nip width parameters to achieve an adjusted fuser nip width. At 350, a media sheet can be transported through the fuser nip with the adjusted fuser nip width. At 360, nip width feedback of the adjusted fuser nip width can be obtained after transporting the media sheet through the fuser nip. At 370, the fuser nip width can be further adjusted based on the nip width feedback to achieve a feedback adjusted fuser nip width. At 380, an image can be fused on the media sheet using the feedback adjusted fuser nip width.

Figure 4:
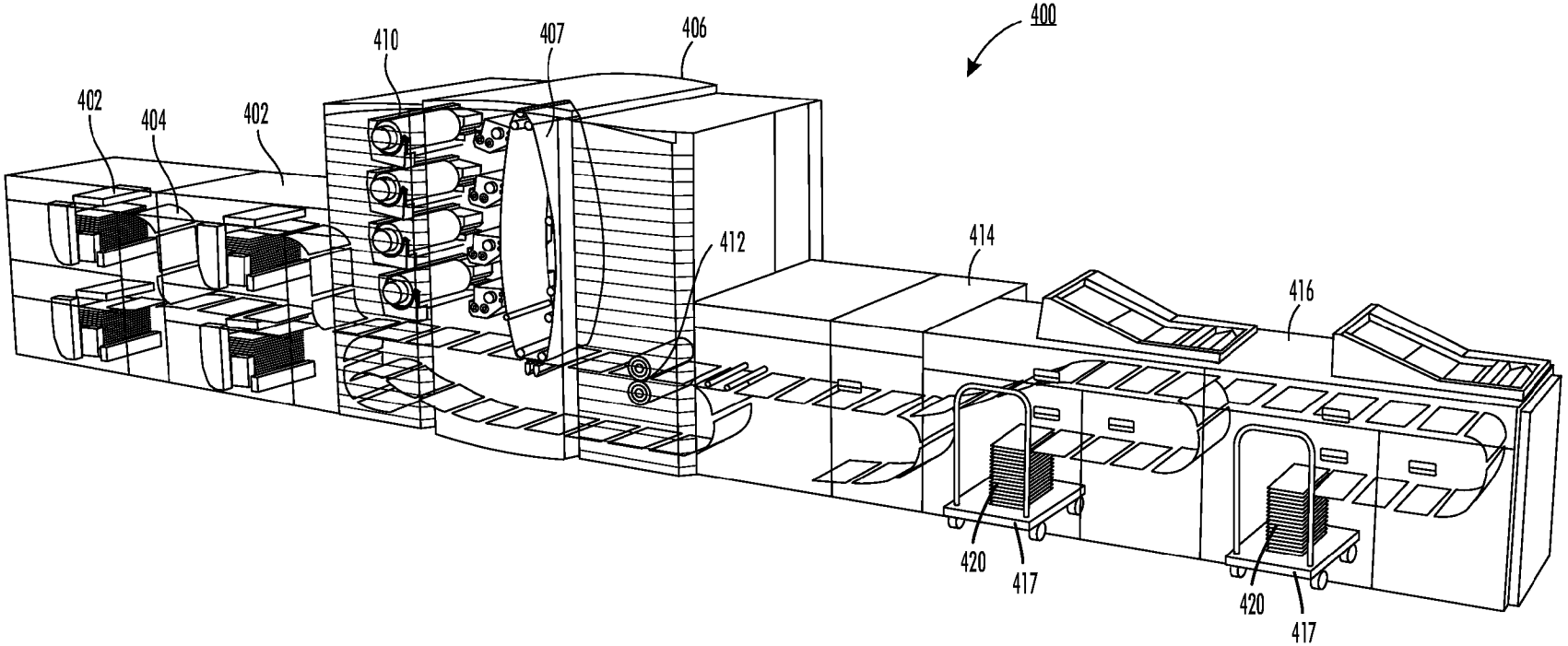
FIG. 4 illustrates an exemplary printing apparatus.

FIG. 4 illustrates an exemplary printing apparatus 400, such as the apparatus 100. As used herein, the term "printing apparatus" encompasses any apparatus, such as a digital copier, bookmaking machine, multifunction machine, and other printing devices that perform a print outputting function for any purpose. The printing apparatus 400 can be used to produce prints from various media, such as coated, uncoated, previously marked, or plain paper sheets. The media can have various sizes and weights. In some embodiments, the printing apparatus 400 can have a modular construction. As shown, the printing apparatus 400 can include at least one media feeder module 402, a printer module 406 adjacent the media feeder module 402, an inverter module 414 adjacent the printer module 406, and at least one stacker module 416 adjacent the inverter module 414.

In the printing apparatus 400, the media feeder module 402 can be adapted to feed media 404 having various sizes, widths, lengths, and weights to the printer module 406. In the printer module 406, toner is transferred from an arrangement of developer stations 410 to a charged photoreceptor belt 407 to form toner images on the photoreceptor belt 407. The toner images are transferred to the media 404 fed through a paper path. The media 404 are advanced through a fuser 412 adapted to fuse the toner images on the media 404. The inverter module 414 manipulates the media 404 exiting the printer module 406 by either passing the media 404 through to the stacker module 416, or by inverting and returning the media 404 to the printer module 406. In the stacker module 416, printed media are loaded onto stacker carts 417 to form stacks 420.

Although some embodiments of the above description are directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a media transport configured to transport a media sheet in a media sheet travel direction;

a fuser assembly configured to fuse an image on the media sheet, the fuser assembly including a first fuser member rotationally supported in the apparatus, the first fuser member being configured to fuse an image on the media sheet, and the fuser assembly including a second fuser member rotationally supported in the apparatus and coupled to the first fuser member at a fuser nip, the second fuser member being configured to fuse an image on the media sheet, where the fuser nip has a fuser nip width parallel to the media sheet travel direction;

a controller coupled to the fuser assembly, the controller configured to control operations of the apparatus;

a nip width profile generation module coupled to the controller, the nip width profile generation module configured to determine fuser nip width parameters based on media sheet properties and fuser assembly properties; and a feedback module coupled to the controller, the feedback module configured to adjust the fuser nip width parameters based on nip width feedback to achieve a desired fuser nip width, wherein the fuser assembly is configured to be adjusted according to the determined fuser nip width parameters, the controller is configured to further adjust the fuser nip width by adjusting a fuser assembly load based on the determined fuser nip width parameters and the nip width feedback, and the controller adjusts the fuser assembly load by separately adjusting a first load at a first end of the fuser assembly and a second load at a second end of the fuser assembly based on the determined fuser nip width parameters and the nip width feedback.

2. The apparatus according to claim 1, further comprising a nip width measurement module coupled to the feedback module, the nip width measurement module configured to provide nip width feedback in the form of at least one nip width measurement relating to nip width.

3. The apparatus according to claim 1, wherein the nip width profile generation module is further configured to provide the fuser nip width parameters to the controller.

4. The apparatus according to claim 1, wherein the feedback module is further configured to adjust the fuser nip width based on the nip width feedback to achieve the desired fuser nip width to reduce media sheet delta gloss variation.

5. The apparatus according to claim 1, wherein the nip width profile generation module is further configured to determine the fuser nip width parameters based on media sheet properties and fuser assembly properties to determine fuser nip width parameters that reduce edge pressure and shear stress at a media sheet edge.

6. The apparatus according to claim 1, wherein the fuser assembly properties include fuser assembly hardness.

7. The apparatus according to claim 1, wherein the media sheet properties include media sheet size and thickness.

8. The apparatus according to claim 1, further comprising an output configured to receive the fuser nip width parameters and output the fuser nip width parameters to a user of the apparatus.

9. A method in an apparatus including a fuser assembly configured to fuse an image on a media sheet traveling in a media sheet travel direction, the fuser assembly including a fuser nip, the fuser nip having a fuser nip width parallel to the media sheet travel direction, the method comprising:

determining fuser nip width parameters based on media sheet properties and fuser assembly properties;

adjusting the fuser nip width based on the fuser nip width parameters to achieve an adjusted fuser nip width;

transporting a media sheet through the fuser nip;

obtaining nip width feedback of the adjusted fuser nip width after transporting the media sheet through the fuser nip;

further adjusting the fuser nip width based on the nip width feedback to achieve a feedback adjusted fuser nip width; and fusing an image on the media sheet using the feedback adjusted fuser nip width, wherein the further adjusting comprises separately adjusting a first load at a first end of the fuser assembly and a second load at a second end of the fuser assembly based on the nip width feedback to achieve the feedback adjusted fuser nip width.

10. The method according to claim 9, wherein adjusting comprises adjusting the fuser nip width by adjusting a fuser assembly load based on the fuser nip width parameters to achieve the adjusted fuser nip width.

11. The method according to claim 9, wherein obtaining nip width feedback comprises taking nip width measurements after transporting the media sheet through the fuser nip.

12. The method according to claim 9, wherein the fuser assembly properties include fuser assembly hardness and media sheet properties include media sheet size and thickness.

13. The method according to claim 9, further comprising outputting the fuser nip width parameters to a user of the apparatus.

14. The method according to claim 9, wherein the determining comprises determining the fuser nip width parameters based on the media sheet properties and on the fuser assembly properties to determine the fuser nip width parameters that at least one of (1) reduce edge pressure at a media sheet edge, (2) reduce shear stress at a media sheet edge, and (3) reduce media sheet delta gloss variation.

* * * * *